US009458993B2

(12) United States Patent
Kim

(10) Patent No.: US 9,458,993 B2
(45) Date of Patent: Oct. 4, 2016

(54) LIGHTING DEVICE ENABLING ARBITRARY DISTRIBUTION OF LIGHT

(71) Applicant: KMW INC., Hwaseong, Gyeonggi-Do (KR)

(72) Inventor: Duk Yong Kim, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 140 days.

(21) Appl. No.: 14/466,436

(22) Filed: Aug. 22, 2014

(65) Prior Publication Data

US 2014/0362593 A1 Dec. 11, 2014

Related U.S. Application Data

(63) Continuation of application No. PCT/KR2013/001383, filed on Feb. 21, 2013.

(30) Foreign Application Priority Data

Feb. 23, 2012 (KR) ..... 10-2012-0018348
Jan. 31, 2013 (KR) ..... 10-2013-0010767

(51) Int. Cl.
*F21V 14/02* (2006.01)
*F21V 19/02* (2006.01)
(Continued)

(52) U.S. Cl.
CPC ..... *F21V 14/02* (2013.01); *F21V 19/02* (2013.01); *F21V 21/14* (2013.01); *F21V 21/29* (2013.01);
(Continued)

(58) Field of Classification Search
CPC ..... F21V 14/02; F21V 19/02; F21V 21/30; F21V 21/14; F21V 21/29; F21V 7/0083; F21V 23/002; F21V 29/76; F21W 2131/103; F21Y 2101/02
USPC ..... 362/287, 322, 324, 431
See application file for complete search history.

(56) References Cited

U.S. PATENT DOCUMENTS 3,803,400 A * 4/1974 Ozawa ..... B60Q 3/0286 362/372
5,070,434 A * 12/1991 Suman ..... B60Q 3/0279 362/490

(Continued)

FOREIGN PATENT DOCUMENTS

DE 10 2004 023358 B3 4/2006
DE 20 2011 0516161 U1 11/2011

(Continued)

*Primary Examiner* — Laura Tso
(74) *Attorney, Agent, or Firm* — Mintz Levin Cohn Ferris Glovsky and Popeo, P.C.; Kongsik Kim; Colleen H. Witherell

(57) ABSTRACT

The present invention relates to a lighting device enabling arbitrary distribution of light, which includes: a hollow receptacle having a cover to be opened or closed; a pivot part mounted in a fixing hole provided in the bottom of the receptacle so as to be tilted and pivoted; a light module part connected through an adjustment shaft to the pivot part, the light module part being tilted and pivoted by the pivot part so as to control the distribution of light; and a fixing part for adjusting the pivot part to be fixed or to be tilted and pivoted. The present invention enables a plurality of light modules to be separately adjusted to control the distribution of light, and provides fixing means for fixing the positions of the light modules thus adjusted, so that the distribution of light may be controlled regardless of the installed position of the lighting device, thereby preventing light from penetrating into surrounding buildings.

22 Claims, 15 Drawing Sheets

(51) Int. Cl.

| | |
|---|---|
| ***F21V 21/14*** | (2006.01) |
| ***F21V 21/29*** | (2006.01) |
| *F21V 21/30* | (2006.01) |
| *F21W 131/103* | (2006.01) |
| *F21Y 101/02* | (2006.01) |
| *F21V 7/00* | (2006.01) |
| *F21V 23/00* | (2015.01) |
| *F21V 29/76* | (2015.01) |

(52) U.S. Cl.
CPC ..... *F21V 7/0083* (2013.01); *F21V 21/30* (2013.01); *F21V 23/002* (2013.01); *F21V 29/76* (2015.01); *F21W 2131/103* (2013.01); *F21Y 2101/02* (2013.01)

(56) References Cited

U.S. PATENT DOCUMENTS

| | | | | |
|---|---|---|---|---|
| 5,630,663 | A * | 5/1997 | Ling | F21S 8/02 362/282 |
| 5,655,829 | A | 8/1997 | Lin et al. | |
| 6,616,303 | B1 | 9/2003 | Rosset | |
| 7,011,439 | B1 * | 3/2006 | Kane | G02B 6/4298 362/269 |
| 2002/0044446 | A1 | 4/2002 | Layne et al. | |
| 2008/0002413 | A1 | 1/2008 | Wang et al. | |
| 2009/0154151 | A1 | 6/2009 | Levine | |
| 2010/0039793 | A1 | 2/2010 | Chen | |
| 2011/0019438 | A1 | 1/2011 | Juang et al. | |
| 2012/0162996 | A1 * | 6/2012 | Ikeda | G03B 21/14 362/311.02 |

FOREIGN PATENT DOCUMENTS

| | | | |
|---|---|---|---|
| JP | 2002-501295 | A | 1/2002 |
| JP | 2006-236796 | A | 9/2006 |
| JP | 2008-021615 | A | 1/2008 |
| JP | 3145900 | U | 10/2008 |
| JP | 2009-277479 | A | 11/2009 |
| JP | 2010-177140 | A | 8/2010 |
| JP | 2010-192389 | A | 9/2010 |
| KR | 20-0394755 | Y1 | 9/2005 |
| KR | 10-2008-0096309 | A | 10/2008 |
| KR | 2009 0043215 | A | 5/2009 |
| KR | 10-0961676 | B1 | 6/2010 |
| KR | 10-2011-0035379 | A | 4/2011 |
| KR | 10-2011-0042720 | A | 4/2011 |
| KR | 10-2011-0077237 | A | 7/2011 |
| KR | 10-2011-0108269 | A | 10/2011 |

* cited by examiner

LIGHTING DEVICE ENABLING ARBITRARY DISTRIBUTION OF LIGHT

CROSS-REFERENCE TO RELATED APPLICATIONS

This application is a continuation of International Application No. PCT/KR2013/001383 filed on Feb. 21, 2013, which claims a priority to Korean Patent Application No. 10-2012-0018348 filed on Feb. 23, 2012 and Korean Patent Application No. 10-2013-0010767 filed on Jan. 31, 2013, which applications are incorporated herein by reference.

TECHNICAL FIELD

The present invention relates to a lighting device enabling arbitrary light distribution, and more particularly, to a lighting device enabling arbitrary light distribution, which can freely adjust light distribution of an individual light.

BACKGROUND ART

Recently, the Ministry of Environment in Korea has declared a "law for preventing light pollution generated by artificial lighting". This law will be enforced from Feb. 1, 2013. The main contents are to protect national health from abusement of the artificial lighting, to prevent harm affecting an ecosystem, and to manage excessive light and intrusive light by determining an acceptable light radiation standard of building lighting, an electronic sign, and lighting of various infrastructures.

At night, in order to prevent generation of the intrusive light which indicates that beams of light of city infrastructure lighting, building lighting, and electronic signs intrude into surrounding buildings, street lights and other lights should follow a light reflection acceptance standard, and light distribution which indicates directions of light radiation should be adjusted.

The light distribution using a Light Emitting Diode (LED) according to the related art relates to a structure of enlarging light distribution of a lighting module as in Patent Laid-Open Publication No. 10-2011-0108269, or relates to a method of adjusting light distribution using a lens as in Patent Registration No. 10-0961676.

However, the structures for enlarging light distribution of a lighting module have a problem in that light pollution is increased by increasing penetration light according to an increase in a light distribution area thereof. Further, the technologies for adjusting light distribution using a lens have problems in that an optical efficiency may be reduced by use of a lens, a proper lens should be replaced as needed, and a proper lens corresponding to each of the lights should be made.

SUMMARY

The present invention is conceived to solve the aforementioned problems, and an aspect of the present invention is to provide a lighting device enabling arbitrary light distribution, which can arbitrarily adjust light distribution according to a surrounding environment.

In order to solve the aforementioned problems, a lighting device enabling arbitrary light distribution is provided. The lighting device includes: one or more fixing holes provided on a fastening plate; a rotational portion inserted into the fixing hole to be tilted and rotated; and an optical module portion coupled to the rotational portion, light distribution of the optical module portion being adjusted according to the tilting and the rotating of the rotational portion.

A lighting device enabling arbitrary light distribution according to the present invention has effects that light distribution of a plurality of optical modules can be individually adjusted, a fixing means for fixing a location of an optical module, light distribution of which has been adjusted, is provided so as to arbitrarily adjust light distribution regardless of an installation location, and penetration light penetrated into surrounding buildings is not generated.

That is, the lighting device enabling arbitrary light distribution according to the present invention has effects that an installer can arbitrarily adjust light distribution, and an area where lighting is needed and an area where lighting is not needed are separately illuminated, thereby preventing generation of light pollution.

DETAILED DESCRIPTION

Hereinafter, a lighting device enabling arbitrary light distribution according to an exemplary embodiment of the present invention will be described with reference to the accompanying drawings.

Figure 1:
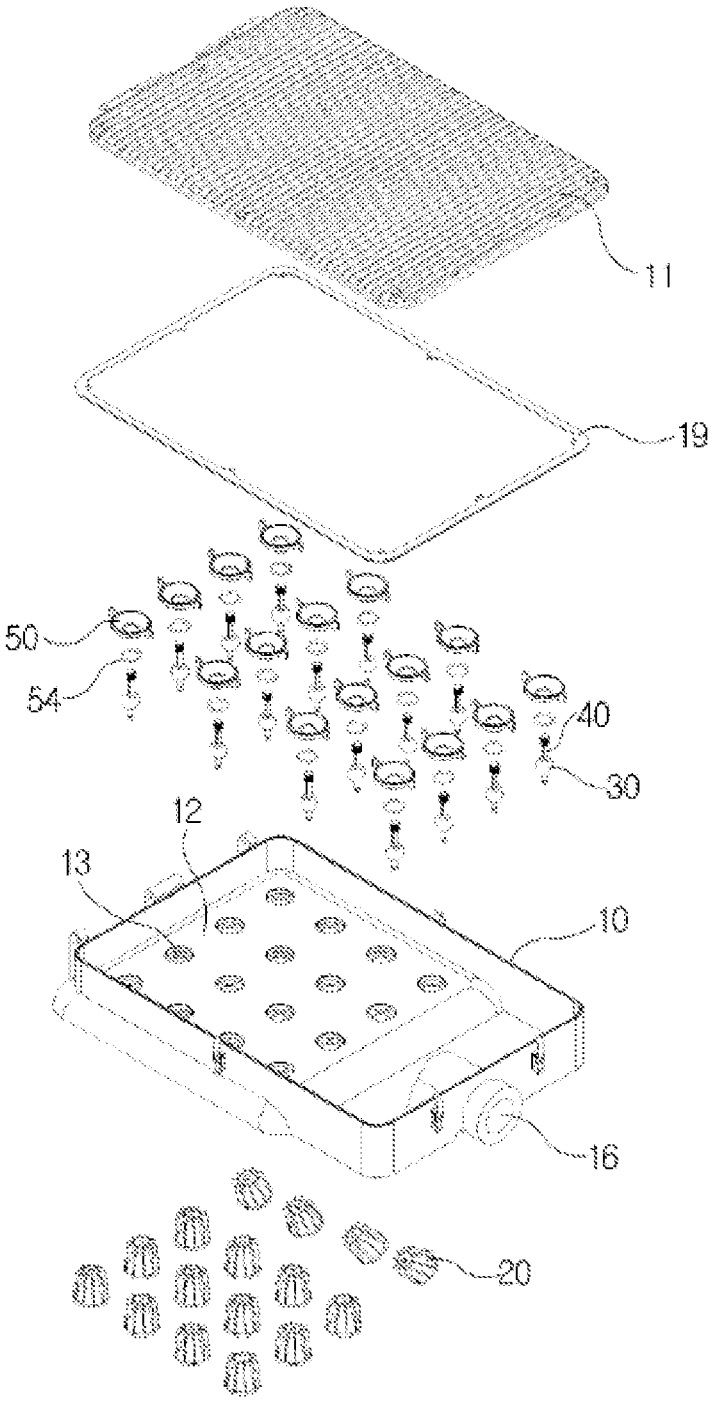
FIG. 1 is an exploded perspective view illustrating a lighting device enabling arbitrary light distribution according to an exemplary embodiment of the present invention.

FIG. 1 is an exploded perspective view illustrating a lighting device enabling arbitrary light distribution according to an exemplary embodiment of the present invention.

Referring to FIG. 1, the lighting device enabling arbitrary light distribution according to an exemplary embodiment of the present invention includes a housing 10 provided with an upper cover 11, a plurality of optical module portions 20 disposed at a lower side of the housing 10, a rotational portion 30 for rotatably and tiltably fixing the optical module portion 20 to a bottom portion 12 of the housing 10, an adjustment shaft portion 40 for connecting the rotational portion 30 and the optical module portion 20 to each other to rotate and tilt the optical module portion 20 according to the rotating of the rotational portion 30, a fixing portion 50 for fixing the rotational portion 30 in a state in which light distribution of the optical module portion 20 is adjusted by the rotating and the tilting of the rotational portion 30.

The non-described reference numeral 19 corresponds to a sealing portion located between the housing 10 and the upper cover 11.

The upper cover 11 is hinge-coupled to a side portion of the housing to be openable, a fixing hole 13 into which a part of a lower portion of the spherical rotational portion 30 is inserted is provided on the bottom portion 12 of the housing 10.

The diameter of the rotational portion 30 is larger than that of the fixing hole 13, so that the rotational portion 30 can prevent the fixing hole 13 from being separated from the outside of the housing 10, which corresponds to a lower side thereof.

Figure 2:
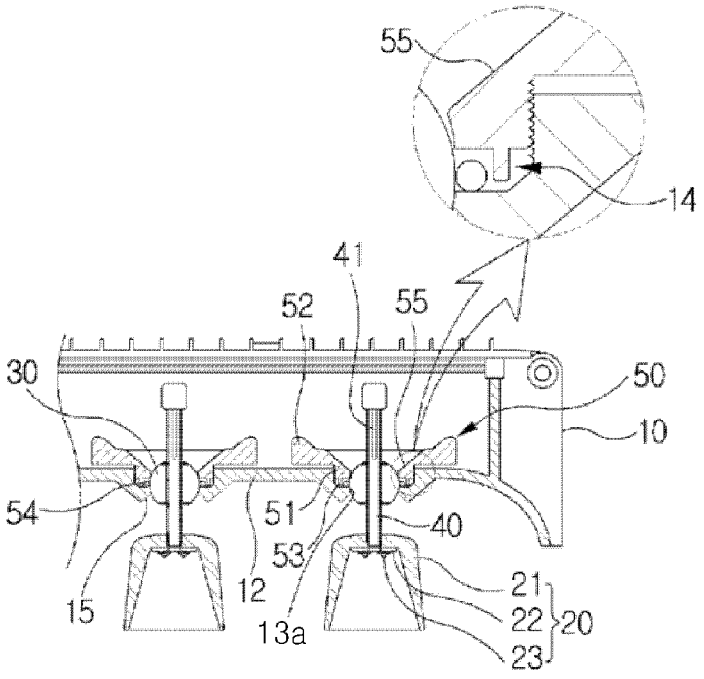
FIG. 2 is a sectional view illustrating a part of a coupling state of a lighting device enabling arbitrary light distribution according to an exemplary embodiment of the present invention.

FIG. 2 is a sectional view illustrating a part of a lighting device enabling arbitrary light distribution according to an exemplary embodiment of the present invention.

As illustrated, a connection portion 13*a* connected to the rotational portion 30, i.e. an edge of the fixing hole 13, supports the lower side of the rotational portion 30 and has a curved surface of which the upper side is wider such that the rotational portion 30 can be rotated and tilted.

Further, the bottom surface 12 adjacent to the fixing hole 13 has a coupling groove 14 formed lower than the other area of the bottom surface 12, and screw threads are provided at the inner side of the coupling groove 14 so that the fixing portion 50 is disconnected from or connected to the rotational portion 30 while being upwardly or downwardly moved along a rotational direction.

The aforementioned form of the coupling groove 14 may be modified in various forms, and the fixing portion 50 may be also modified in various forms according to the modified examples. The aforementioned other examples will be described in more detail afterward.

The shape of the bottom surface of the coupling groove 14 has a sloped surface 15 sloped such that the diameter thereof is widened as it goes from the bottom surface of the fixing hole 13 to the outside to be suitable for limiting the tilting angle of the optical module portion 20.

In this structure, an operator installs the housing 10, opens the upper cover 11, unfastens the fixing portion 50, and then allows the rotational portion 30 to be tilted and rotated.

As illustrated in FIG. 2, the adjustment shaft portion 40 vertically passes through the rotational portion 30, the lower side of the adjustment shaft 40 is connected to the optical module portion 20, and the upper side of the adjustment shaft portion 40 is exposed to the upper side of the rotational portion 30, and is located within the housing 10.

The upper side of the adjustment shaft portion 40 is manipulated by a hand to tilt and rotate the optical module portion 20 so as to adjust light distribution of the optical module portion 20.

In addition, the adjustment shaft portion 40 can be automatically manipulated by using a driving means such as a motor, a control line for controlling the driving means can be extend to the outside. Such an automatic control scheme may be modified in various forms by those skilled in the art, and the configuration for the automatic control belongs to the present invention as long as another structure of the present invention is employed equally or similarly.

When the light distribution of the optical module portion 20 is adjusted by rotating or tilting the rotational portion 30, the lower portion of the adjustment shaft portion 40 can be tilted only in an area limited by the sloped surface 15. Such a limiting of the tilting is configured for preventing the light distributions of the plurality of optical module portions 20 from overlapping each other.

However, as in another embodiment of the present invention which will be described below, the light distributions of the optical module portions 20 may be allowed to overlap each other, and at this time, the sloped surface 15 does not exist.

In this way, after the light distribution of one optical module portion 20 is adjusted, the fixing portion 50 is rotated and locked, thereby fixing the rotational portion 30 not to be rotated or tilted any more.

The fixing portion 50 may have a configuration in which an insertion fastening portion 51 inserted into the coupling groove 14 and having a screw structure engaged with the screw threads of the coupling groove 14 and formed at the outer peripheral surface thereof, a body 55 protruding toward the upper side of the insertion fastening portion 51 and having a sloped surface of which the step is lowered as the upper surface thereof goes toward the central side, and a handle portion 52 coupled to both ends of the outer diameter portion of the body 55 and extending upwardly so as to enable an operator to easily rotate the optical module portion 20 by his/her hand, are integrally provided.

That is, the fixing portion 50 enables an operator to perform unfastening or locking with his/her hand and even without a separate tool, thereby easily performing an adjustment operation of light distribution.

A lower locking step 53 having a lower surface protruding circularly at a location spaced apart from the rotational portion 30 from a predetermined distance is provided on the bottom surface of the insertion fastening portion 51, and an O-ring 54 is located between the lower locking step 53 and the rotational portion 30.

It is preferred that the inner diameter of the O-ring 54 is smaller than the maximum diameter of the spherical rotational portion 30, thereby providing a waterproof effect, and serving to firmly fix the rotational portion 30 when the fixing portion 50 is locked. Further, the O-ring 54 is made of a general flexible material, and is laterally spread and pressed when the fixing portion 50 is pressed to be locked, thereby improving the waterproof effect thereof. The O-ring 54 serves to smoothly rotate the rotational portion 30 in a state in which the fixing portion 50 is unfastened.

The optical module portion 20 includes a housing 21 having a hollow interior having a bell-shaped sectional surface, a toroidal substrate 22 provided at an inner upper portion of the housing 21, and a Light Emitting Diode (LED) 23 fixed to the bottom surface of the substrate 22 and installed such that a light emitting surface thereof faces a lower side.

Such a structure of the optical module portion 20 has a general form of an optical module using an LED 23, and the present invention is not limited to such a detailed form of the optical module portion 20, and may be modified in various forms. For example, the optical module portion 20 according to the present invention is not limited by the size or the slope angle of the inner surface of the housing 21.

It is preferred that the adjustment shaft portion 40 connected to the optical module portion 20 in order to supply electric power to the substrate 22 has a hollow shape such that an electric wire (not illustrated) may be inserted thereinto, and a withdrawal hole 41 may be provided at a part of the upper portion of the adjustment shaft portion 40 such that the electric wire may be connected to an electric wire of the outside of the housing 10 by being interconnected to the interior of the housing 10. The housing 10 has an external coupling portion 16 provided at one side thereof and capable of being coupled and fixed to a support (not illustrated), and the electric wire of the outside can be connected to the housing 10 through the external coupling portion 16.

At this time, the withdrawal hole 41 has a slit shape, thereby preventing disconnection of the electric wire caused by moving of the adjustment shaft portion 40, and preventing the tilting and the rotating of the adjustment shaft portion 40 from being limited by the electric wire.

Figure 3:
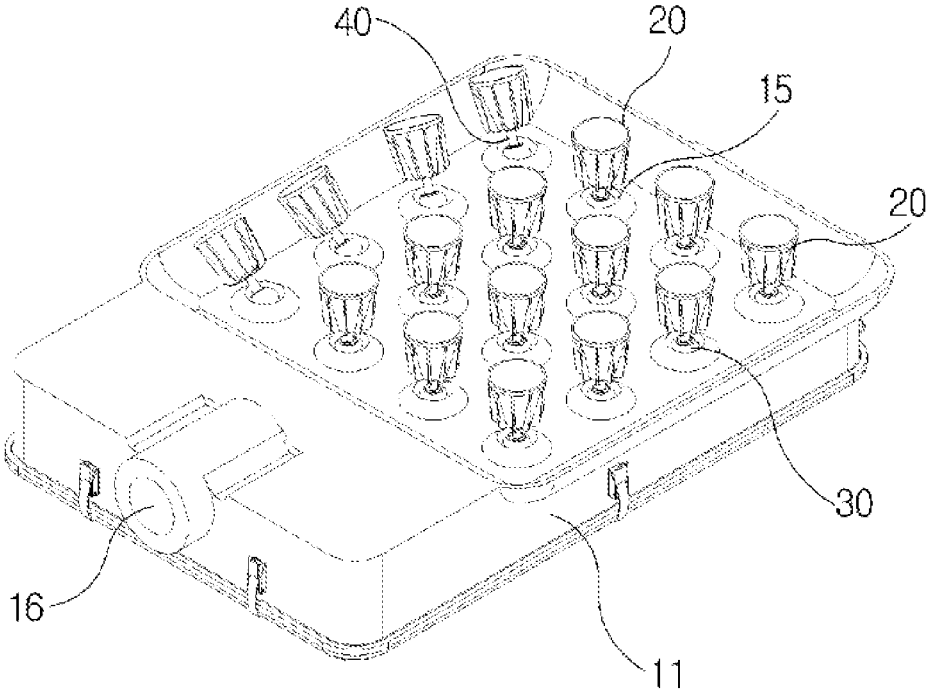
FIG. 3 is a bottom view illustrating a lighting device enabling arbitrary light distribution according to an exemplary embodiment of the present invention, of which arbitrary light distribution has been adjusted through the aforementioned adjustment of light distribution.

FIG. 3 is a bottom view illustrating a lighting device enabling arbitrary light distribution according to an embodiment of the present invention, of which arbitrary light distribution has been adjusted through the aforementioned adjustment of light distribution.

Referring to FIG. 3, the present invention can manually or automatically adjust light distribution of each of the plurality of the optical module portions 20, and can accurately adjust light distribution by separately illuminating an area where lighting is needed and an area where lighting is not needed.

Therefore, the light pollution can be prevented from being caused by radiating unnecessary light to the area where the lighting is not needed, such as an interior of a building, a field, a rice paddy, an orchard, etc.

Figure 4:
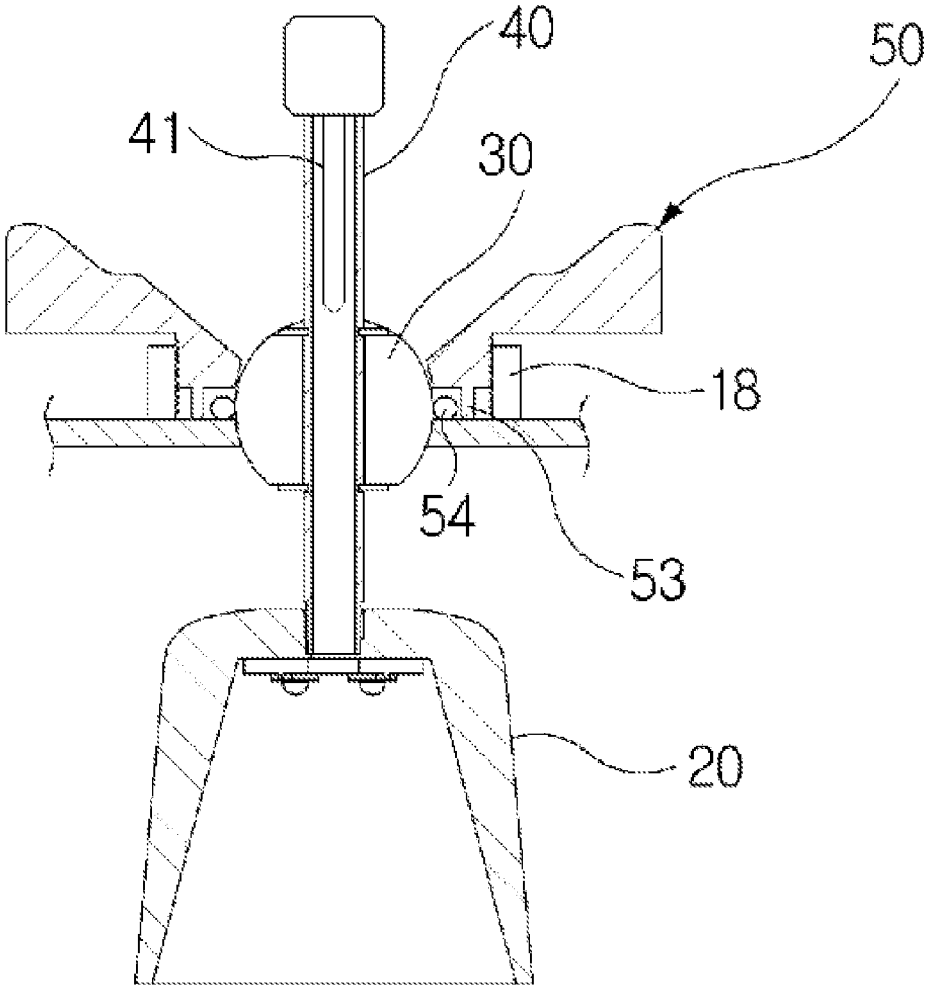
FIGS. 4 to 6 are sectional views illustrating parts of lighting devices enabling arbitrary light distribution according to other embodiments of the present invention.

FIG. 4 is a sectional view illustrating a part of a lighting device enabling arbitrary light distribution according to another embodiment of the present invention.

Referring to FIG. 4, the lighting device enabling arbitrary light distribution according to another embodiment of the present invention has a structure in which a bottom portion 12 around a fixing hole 13 of a housing 10 has a flat structure, and a coupling portion 18 having a circular sectional surface protrudes around the fixing hole 13 of the bottom portion 12.

Screw threads are provided on the cylindrical inner surface of the coupling portion 18 so as to be rotation-coupled to an insertion fastening portion 51 of a fixing portion as described above, and the rotational portion 30 can be adjusted either in a tillable and rotatable state or in an untiltable and unrotatable state by manipulating a handle 52 of the fixing portion 50.

At this time, since a surrounding portion of the adjustment shaft portion 40 for connecting the rotational portion 30 and the optical module portion 20 does not have the slope surface 10 on the bottom surface of the coupling groove 14 in the embodiment described with reference to FIG. 2, a tilting angle is not limited and can be adjusted to the maximum tilting angle.

Such a structure implies that the light distribution according to the present invention can be performed excessively, so that the light distribution of the lighting device according to the present invention can be freely adjusted while not being limited by an installation angle of the housing 10.

Figure 5:
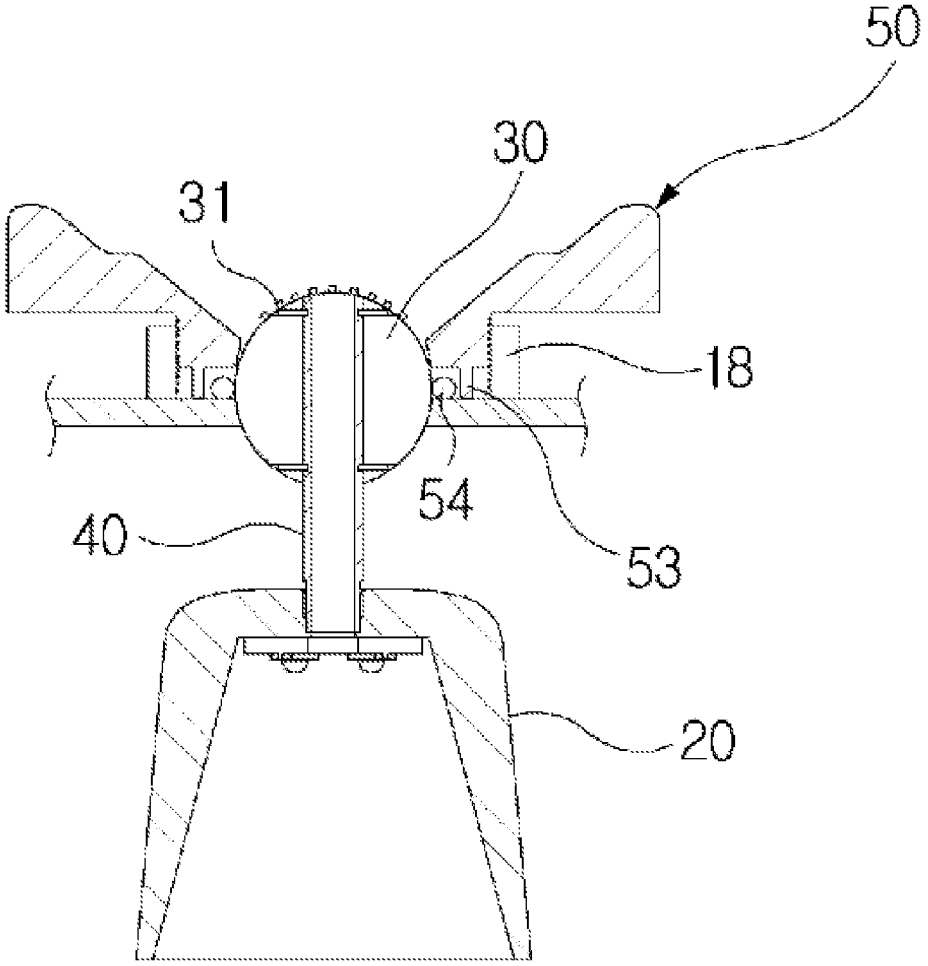

FIG. 5 is a sectional view illustrating a part according to another embodiment of the present invention.

Referring to FIG. 5, the adjustment shaft portion 40 according to the present invention may have a structure of connecting the rotational portion 30 and the optical module portion 20 to each other and not protruding toward the upper side of the rotational portion 30, differing from the configuration of FIG. 2 of protruding and extending toward the upper side of the rotational portion 30.

At this time, an uneven pattern portion 31 is provided at a part of the upper portion of the rotational portion 30 to easily tilt and rotate the rotational portion 30, and an operator can tilt and rotate the rotational portion 30 by allowing his/her finger to be in contact with the uneven pattern portion 31 and rubbing the uneven pattern portion 31.

Such a structure is to more thinly manufacture the thickness of the housing 10 thinner.

Figure 6:
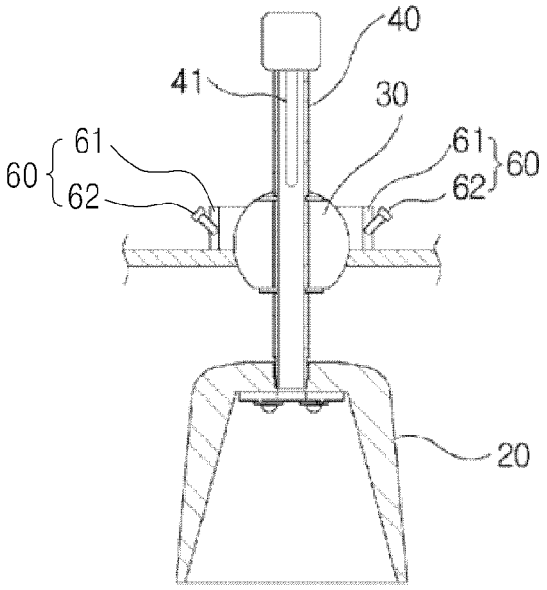

FIG. 6 is a sectional view illustrating a part according to another embodiment of the present invention.

Referring to FIG. 6, the present invention can employ a bolt-type fixing portion 60 in addition to the fixing portion 50 illustrated in FIG. 2, in order to adjust the rotational portion 30 in a tiltable and rotatable state or an untiltable and unrotatable state.

At this time, a coupling portion 61 having a form similar to the coupling portion of FIG. 4 is provided, but the coupling portion 61 does not have screw threads formed at the inner diameter side thereof, has screw holes at a lateral side thereof, and can fix the rotational portion 30 or make the rotational portion 30 be in a tiltable and rotatable state by adjusting an adjustment bolt 62 inserted into the screw holes.

Figure 7:
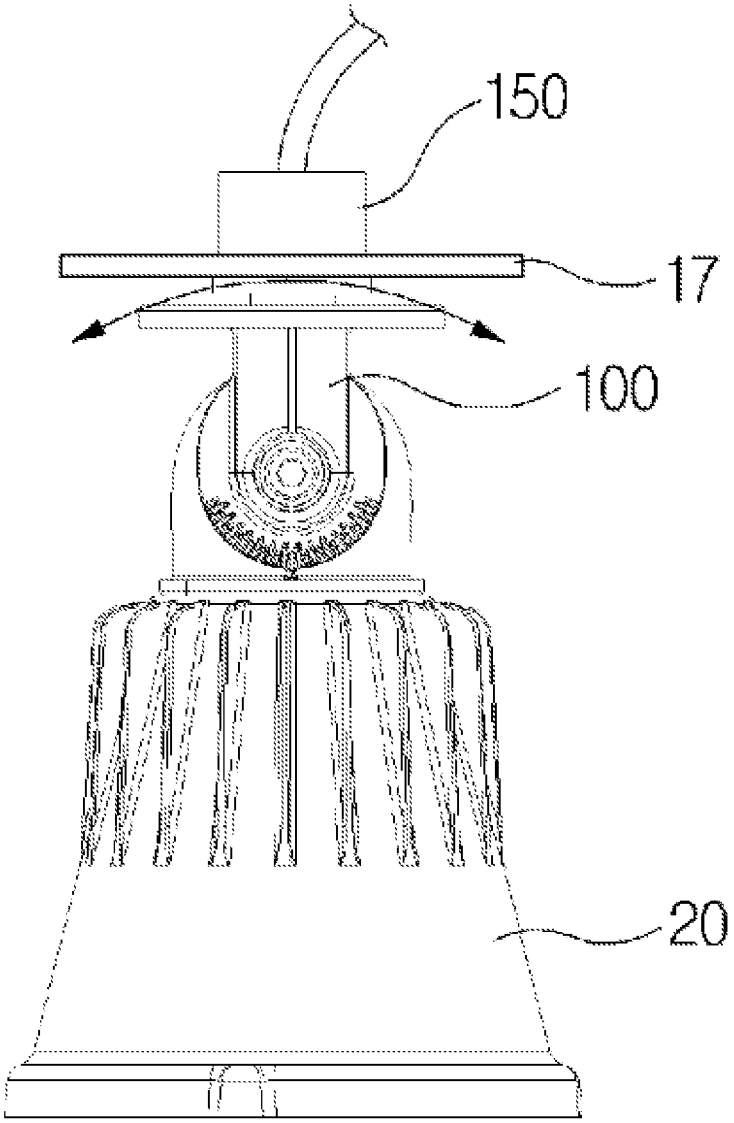
FIG. 7 illustrates a configuration of a lighting device enabling arbitrary light distribution according to another embodiment of the present invention.
Figure 8:
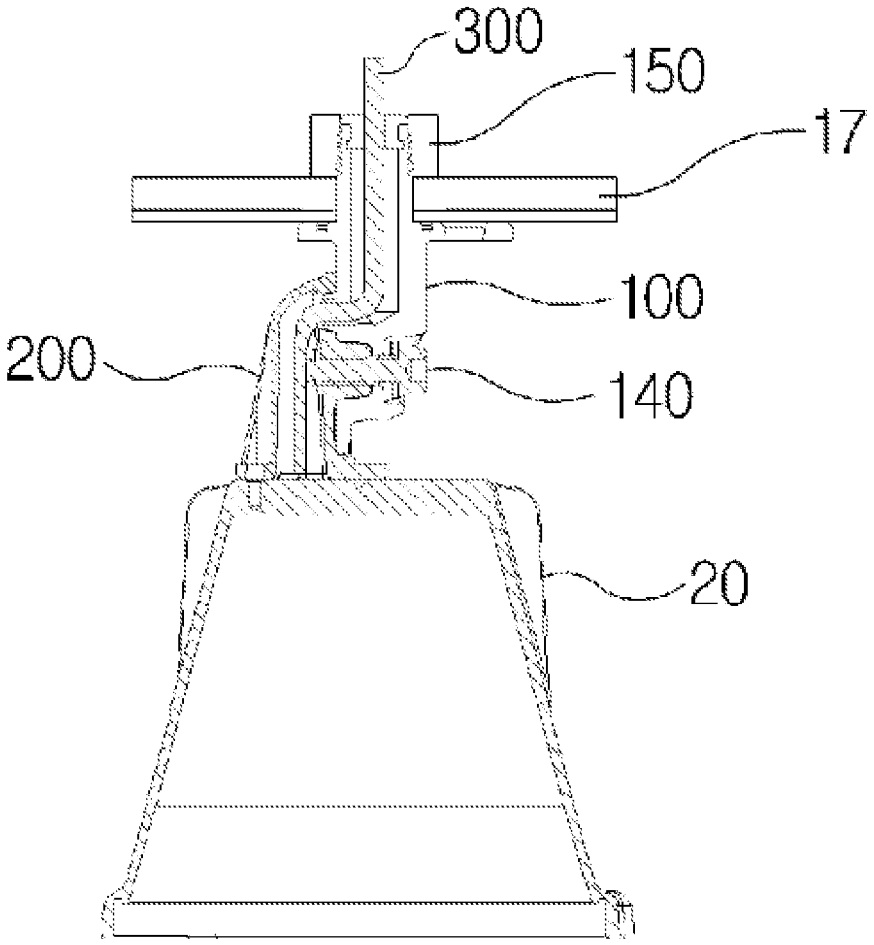
FIG. 8 is a side sectional view of FIG. 7.

FIG. 7 illustrates a configuration of a lighting device enabling arbitrary light distribution according to another embodiment of the present invention, and FIG. 8 is a side sectional view of FIG. 7.

Referring to each of FIGS. 7 and 8, the lighting device enabling arbitrary light distribution according to another embodiment of the present invention includes a first rotational portion 100 having an upper portion inserted into a fixing hole provided at a fastening plate 17 and capable of rotating in a direction parallel to the fastening plate 17, a nut 150 being fastened to the upper portion of the fastening plate 17; a second rotational portion 200 rotatably coupled to the lower end of the first rotational portion 100 and capable of rotating in a direction perpendicular to the fastening plate 17, the optical module portion 20 being fixed to the lower end thereof; and an electric wire 300 connected to the optical module portion 20 from the upper portion of the fastening plate 17 through the interiors of the first rotational portion 100 and the second rotational portion 200 to supply electric power.

The first rotational portion 100 and the second rotational portion 200 have the same effect as that of the rotational portion 30 according to the aforementioned embodiment, and the first rotational portion 100 and the second rotational portion 200 refer to a rotational portion.

Hereinafter, a configuration and an effect of the lighting device enabling arbitrary light distribution according to another embodiment of the present invention will be described in more detail.

First, the fastening plate 17 serves as a support member for supporting the optical module portion 20 to rotate the optical module portion by the first rotational portion 100 and the second rotational portion 200, and the number of the fixing holes is equal to the installation number of the optical module portions 20.

The fastening plate 17 corresponds to the bottom portion 12 of the housing 10 in the aforementioned embodiment, but needs not be installed on the bottom portion 12 of the housing 10 and can be installed when the fastening plate 17 is a plate-shaped structure.

Figure 9:
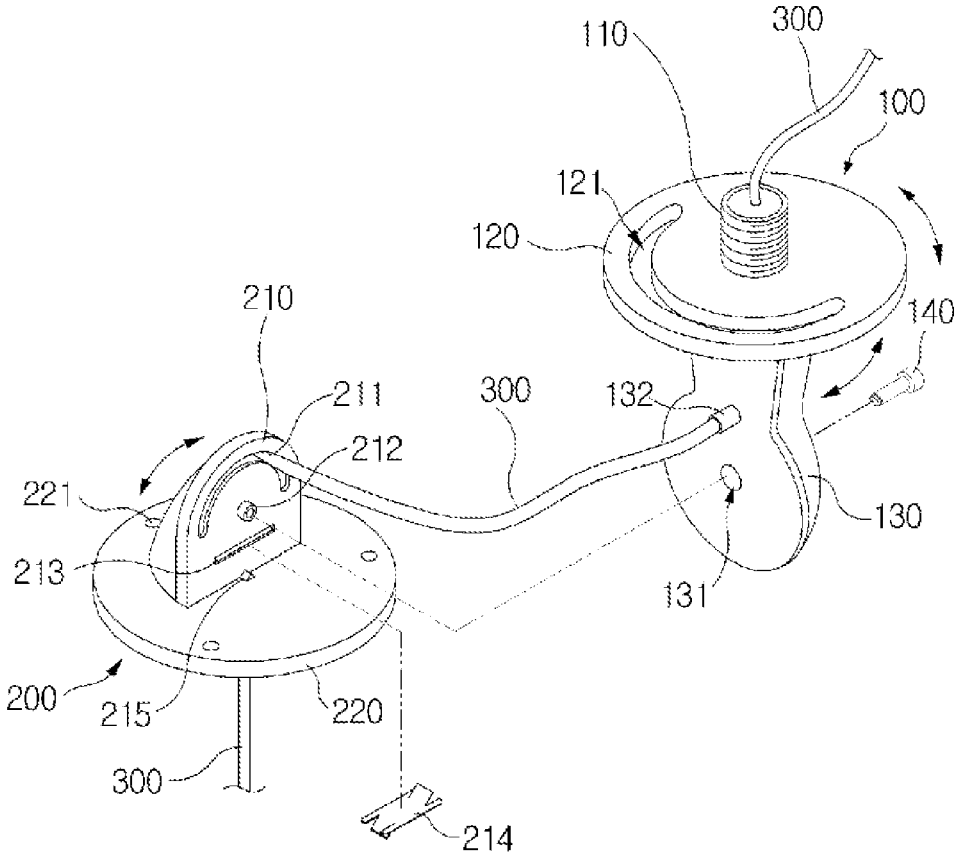
FIG. 9 is an exploded perspective view illustrating a first rotational portion and a second rotational portion which are rotation portions of FIG. 7.
Figure 10:
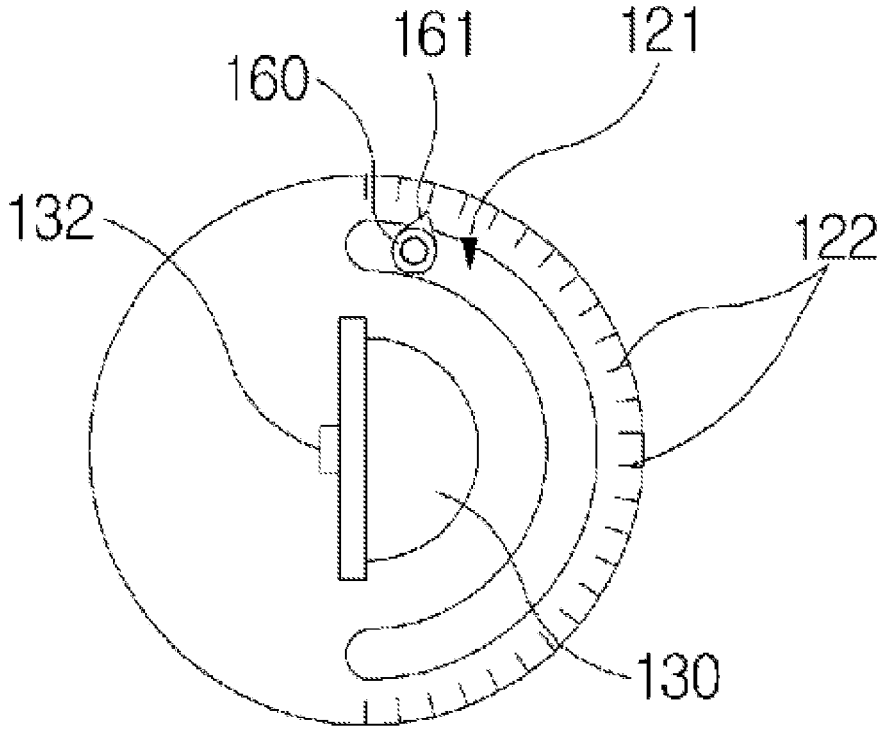
FIG. 10 is a bottom view illustrating the first rotational portion of FIG. 9.
Figure 11:
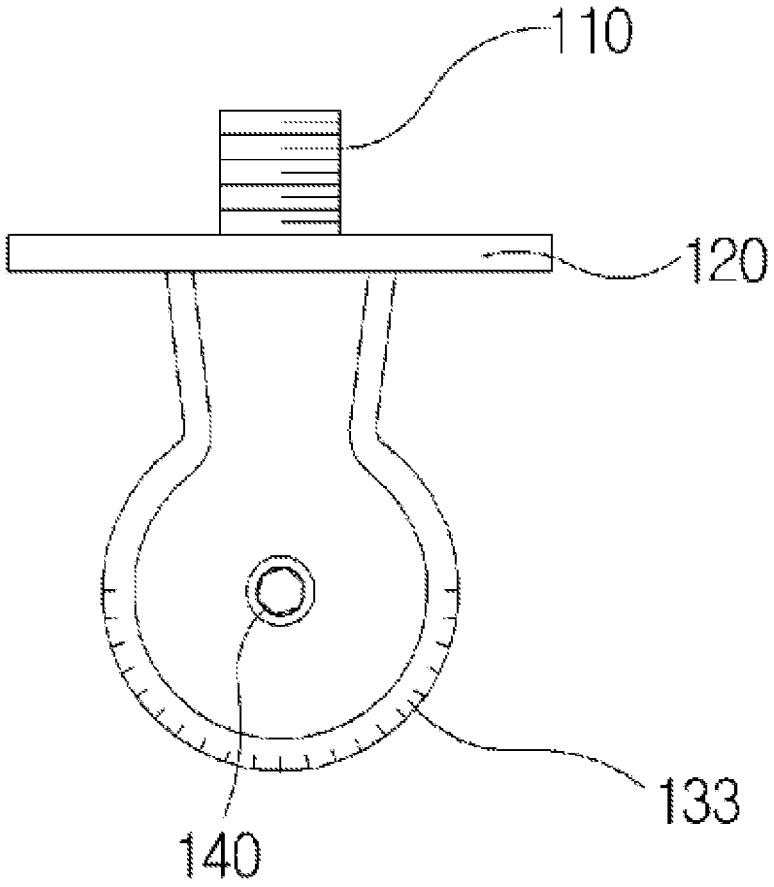
FIG. 11 is a side view illustrating the first rotational portion of FIG. 9.
Figure 12:
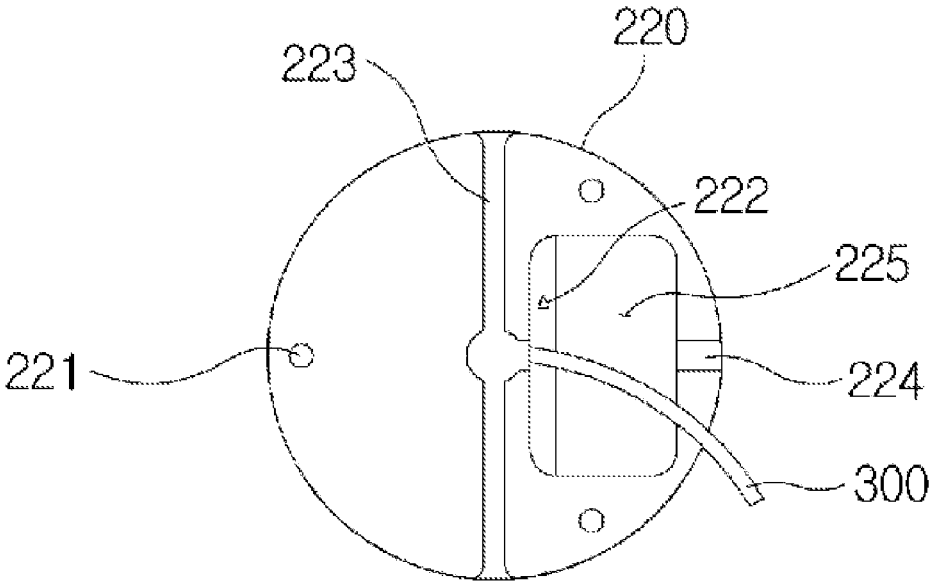
FIG. 12 is a bottom view illustrating the second rotational portion of FIG. 9.

FIG. 9 is an exploded perspective view illustrating the rotational portion, FIG. 10 is a bottom view illustrating the first rotational portion 100, FIG. 11 is a side view illustrating the first rotational portion 100, and FIG. 12 is a bottom view illustrating the second rotational portion 200.

Hereinafter, a configuration and an effect of each portion will be described in more detail with reference to FIGS. 9 to 12.

First, the first rotational portion 100 includes an insertion tube portion 110 inserted into the fixing hole of the fastening plate 17, a rotational plate 120 provided at a circular-arc-shaped first guide groove 121 to identify a rotation degree and having a first gradation portion 122 formed at the bottom surface thereof, and a connection portion 130 downwardly protruding from the bottom surface of the rotational plate 120 and enabling the second rotational portion 200 to be rotatably fastened.

The second rotational portion 200 includes a rotation connection portion 210 coupled to the lateral surface of the connection portion 130 in a rotatable state or a fixed state according to a turning degree of a fixing screw 140, and a fixing plate 220 for fixing the rotation connection portion 20 to the optical module portion 20.

The fastening protrusion portion 212 protrudes at a rotational center of the rotation connection portion 210, and is coupled to the fixing screw 140 while being inserted into a fastening hole 131 of the connection portion 130.

At this time, in a state in which the fixing screw 140 is loosely coupled, the rotation connection portion 210 can rotate in a direction perpendicular to the fastening plate 17, and can rotate the optical module portion 20 fixed by the fixing plate 220 at the lower side thereof.

The electric wire 300 is inserted through the insertion tube portion 110, is introduced into a second guide groove 211 of the second rotational portion 200 through a guide protrusion portion 132 provided at the connection portion 130, and is finally connected to the optical module portion 20 through a through-hole 222 so as to supply electric power to the optical module portion 20.

The insertion tube portion 110 of the first rotational portion 100 is inserted through the fixing hole of the fastening plate 17 from the lower side to the upper side, has a fastening screw provided at the outside thereof, and has a tubular inner surface such that the electric wire 300 is inserted thereinto. The insertion tube portion 110 protruding toward the upper side of the fastening plate 17 is fixed to the nut 150. At this time, the nut 150 is not to fix the first rotational portion 100 to the fastening plate 17 in a completely close contact state but to maintain a state in which the first rotational portion 100 is fastened to the fastening plate 17. Thereafter, a bolt 160 is firmly coupled and fixed to the bottom surface of the fastening plate 170 through the first guide groove 121 in an unrotatable state.

The rotational plate 120 has a diameter larger than that of the insertion tube portion 110, and can horizontally rotate about the fastening plate 17 together with the insertion tube portion 110. A circular-arc-shaped first guide groove 121 is provided configuring the insertion tube portion 110 as a center thereof.

The first guide groove 121 may have a semicircular arc shape of 180 degrees, so as to rotate by 180 degrees in a state in which the bolt 160 fastened to the first guide groove 121 is loosely coupled. In this way, even when the first guide groove 121 rotates by 180 degrees, the second rotational portion 200 can rotate about the fastening plate 17 in a vertical direction, so that the optical module portion 20 coupled to the lower portion of the second rotational portion 200 is substantially in a state of being capable of rotating about the fastening plate 17 by 180 degrees in a horizontal direction.

The first gradation portion 122 is located on the bottom surface of the rotational plate 120 between edges of the first guide groove 121 and the rotational plate 120, thereby identifying a rotation degree of the rotational plate 120.

The rotation degree of the rotational plate 120 uses a location of the bolt 160 as a reference point, and a first indicator 161 protruding toward the first gradation portion 122 at one side of the bolt 160 is provided, thereby identifying an accurate gradation.

The connection portion 130 downwardly protrudes from a bottom central portion of the rotational plate 120, and the shape of the bottom surface thereof has a semispherical shape.

The connection portion 130 is fixed by the fixing screw while being in contact with the rotation connection portion 210 of the second rotational portion 200, and the second rotational portion 200 can be adjusted either in a rotatable state or in an unrotatable state according to a turning degree of the fixing screw 140.

To this end, the connection portion 130 has a fastening hole 131 provided at a rotational center of the rotation connection portion 210, and the rotation connection portion 210 has a fastening protrusion portion 212 inserted into the fastening hole 131. The fixing screw is coupled to the fastening protrusion portion 212 inserted into the fastening hole 131 at one side of the fastening hole 131.

The rotation connection portion 210 can rotate about the fastening protrusion portion 212 in a direction perpendicular to the fastening plate 17, and at this time, a circular-arc-shaped second guide groove 211 is provided to configure the fastening protrusion portion 212 as a center thereof in order to guide the rotation.

The second guide groove 211 serves as a channel for connecting the electric wire 300 as well as to guide the rotation. The guide protrusion portion 132 protruding from the connection portion 130 is inserted into the second guide groove 211, so as to perform stable rotation.

The guide protrusion portion 132 is configured to have a cylindrical structure of which the center is empty and to be connected to the optical module portion 20 through the second guide groove 211 by withdrawing the electric wire 300 inserted through the insertion tube portion 110.

Further, a second gradation portion 133 is provided at the connection portion 130 in order to identify a rotation degree of the rotation connection portion 210. The second gradation portion 133 is located on a surface opposite to one side of the connection portion 310 contacting the rotation connection portion 210.

In order to accurately determine a rotation degree of the rotation connection portion 210, a second indicator 215 is provided at the lower side of the fastening protrusion portion 212 of the rotation connection portion 210.

In this state, it is easy to identify the rotation degree in a perpendicular direction of the fastening plate 17 of the optical module portion 20 which rotates together with the second rotation portion 200 including the rotation connection portion 210.

The optical module portion 20 is generally provided with a housing including a heat dissipation plate, so that it is difficult to maintain a light radiation angle only by using a simple fastening structure. That is, an initially-installed angle may be displaced by effects of wind or gravity. An insertion groove 213 is provided between the fastening protrusion portion 212 of the rotation connection portion 210 and the second indicator 215 in order to prevent this phenomenon, and a rotation restraint portion 214 is inserted and fixed to the insertion groove 213.

The rotation restraint portion 214 increases a friction force between the connection portion 130 and the rotation connection portion 210 when the fixing screw 140 is fastened, thereby preventing the rotation connection portion 210 from being rotated by wind or gravity. Such a detailed configuration of the rotation restraint portion 214 will be described in more detail below.

A fixing plate 220 is provided at the lower portion of the rotation restraint portion 241, and fixes the optical module portion 20 on the bottom surface of the fixing plate 220 by inserting a coupling means such as a bolt into a fixing hole 221.

A through-hole 222 communicating with the second guide groove 211 is located on the bottom surface of the fixing plate 220, so that the electric wire 100 is connected to the optical module portion 20. The through-hole 222 may be exposed by a sloped surface 225 extending to the bottom surface of the fixing plate 220.

Drainage channels 223 and 224 for connecting a part and an edge of the through-hole 222 are provided on the bottom surface of the fixing plate 220. The drainage channels 223 and 224 are configured to prevent an electric short state from being generated in the optical module portion 20 to which the electric wire 300 is connected, by rainwater which may flow therein by any chance.

Since the connection portion 130 and the rotation connection portion 210 are substantially in close contact with each other, it is determined that rainwater does not flow therein. However, in order to prepare for a case where rainwater flows therein through the second guide groove 211 of the rotation connection portion 310 by any chance, it is preferred that the drainage channels 223 and 224 are formed to discharge the rainwater.

Figure 13:
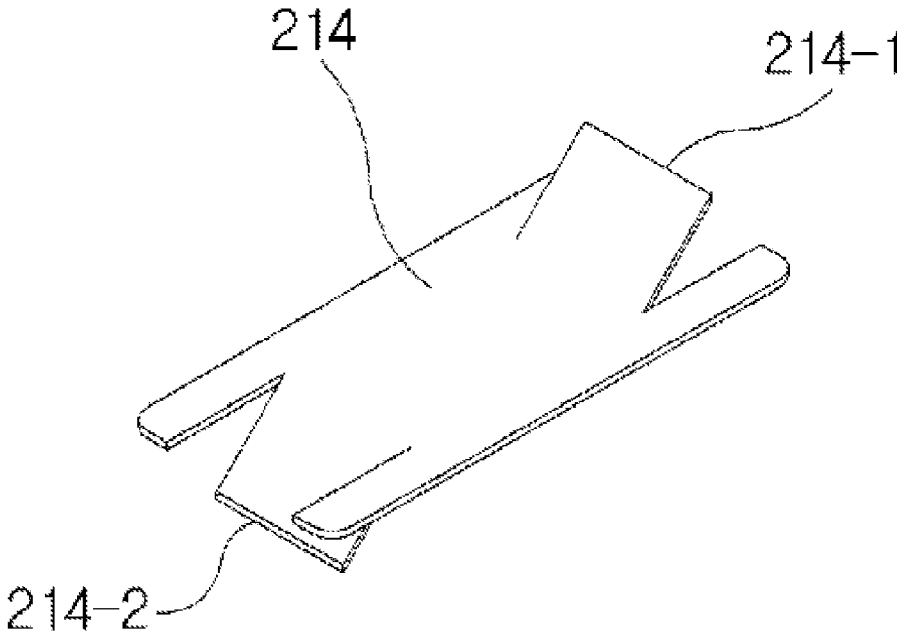
FIG. 13 illustrates a configuration of a rotation restraint portion applied to an embodiment of the present invention.

FIG. 13 illustrates the rotation restraint portion 214 according to an embodiment of the present invention.

Referring to FIG. 13, the rotation restraint portion 214 has a plate-shaped structure in which first and second bent portions 214-1 and 214-2 are provided at central portions of both ends facing a rotational direction of the rotation connection portion 210. At this time, the first bent portion 214-1 and the second bent portion 214-2 are bent toward opposite directions, respectively. This configuration prevents the second rotation portion 200, to which the optical module portion 20 is coupled, from being rotated by wind or gravity, by pressing the first bent portion 214-1 and the second bent portion 214-2 according to the fastening of the coupling screw 140 and increasing a frictional force between the connection portion 130 and the rotation connection portion 210 by restoration forces of the first bent portion 214-1 and the second bent portion 214-2.

Figure 14:
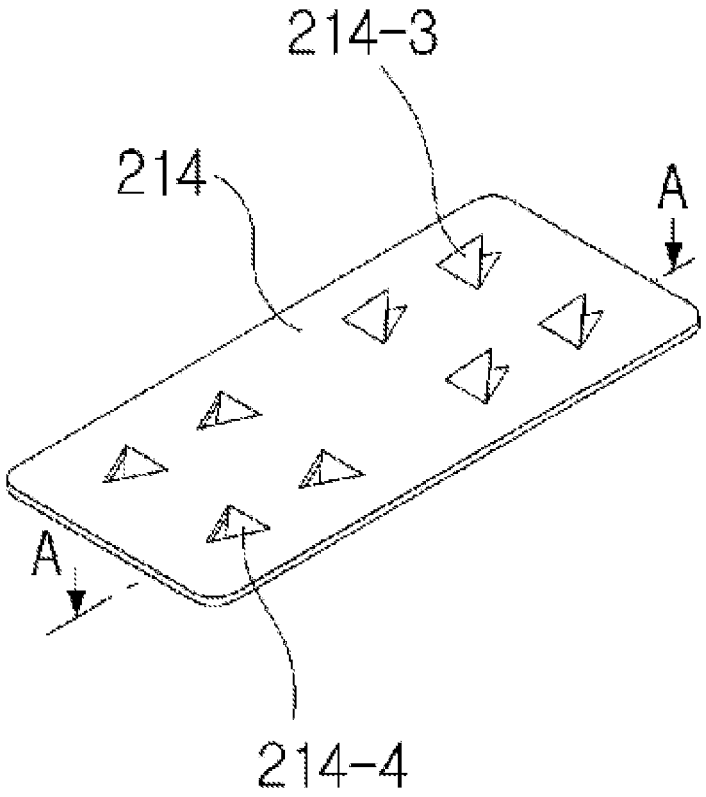
FIG. 14 illustrates a configuration of a rotation restraint portion applied to another embodiment of the present invention.
Figure 15:
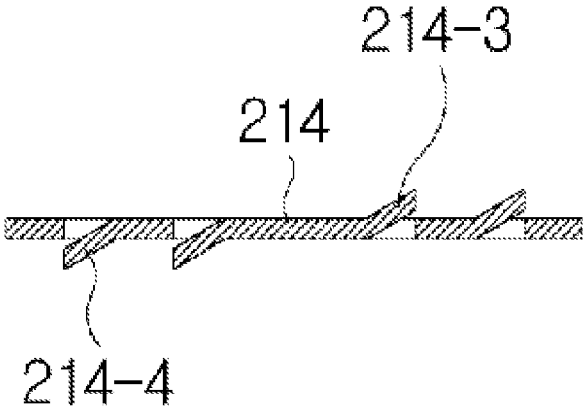
FIG. 15 is a sectional view taken along line A-A of FIG. 14.

FIG. 14 illustrates the rotation restraint portion 214 according to another embodiment of the present invention, and FIG. 15 is a sectional view taken along line A-A of FIG. 14.

Referring to FIGS. 14 and 15, the rotation restraint portion 214 according to another embodiment has a plate-shaped structure, and is configured by third bent portions 214-3 obtained by cutting a part of the plate and bending the cut part upward and fourth bent portions 214-4 obtained by cutting a part of the plate and bending the cut part downward.

Such a structure can make the coupling between the connection portion 130 and the rotation connection portion 210 firmer due to the third bent portions 214-3 and the fourth bent portions 214-4, thereby preventing the second rotational portion 200 including the rotation connection portion 210 from being rotated by wind or gravity.

Using such a configuration, the lighting device enabling arbitrary light distribution according to another embodiment of the present invention can rotate the optical module portion 20 in all directions, so as to be installed to have individual light distribution matched with surrounding environment conditions of installation locations of lights.

It will be obvious to those skilled in the art to which the present invention pertains that the prevent invention is not limited to the aforementioned embodiment, and may be modified and varied without departing from a technical subject matter of the present invention.

The present invention has industrial applicability since, in the lighting device including a plurality of lighting modules, light distribution for each of lights can be adjusted so as to illuminate only an area where lighting is needed.

The invention claimed is:

1. A lighting device enabling arbitrary light distribution, the lighting device comprising:
   - one or more fixing holes provided on a fastening plate;
   - a rotational portion inserted into the fixing hole to be tilted and rotated;
   - an optical module portion coupled to the rotational portion, light distribution of the optical module portion being adjusted according to the tilting and the rotating of the rotational portion; and
   - a fixing portion for fixing the rotational portion in a rotatable and tiltable state,
   - wherein the fixing portion moves upwardly or downwardly, and
   - wherein the fixing portion is connected to an upper side of the rotational portion, so that the rotation portion is adjusted in an unrotatable and untiltable state while the fixing portion moves downwardly.

2. The lighting device as claimed in claim 1, further comprising an adjustment shaft portion for connecting the optical module portion, wherein the rotational portion has a circular shape.

3. The lighting device as claimed in claim 2, wherein a connection portion connected to the rotational portion at an edge of the fixing hole prevents downward separation of the rotational portion, and has a curved surface of which an upper side is wider in order to easily perform the rotating and the tilting.

4. The lighting device as claimed in claim 1, wherein a coupling groove is provided on the fastening plate around the fixing hole, and screw threads are provided at an inner side of the coupling groove, so that the rotational portion is adjusted either in a rotatable and tiltable state or in an unrotatable and untiltable state while the fixing portion moves upwardly or downwardly.

5. The lighting device as claimed in claim 4, wherein a distal surface of the coupling groove is provided with a sloped surface which is sloped such that a diameter thereof is widened as the sloped surface extends from a proximal end of the fixing hole toward a distal end of the distal surface.

6. The lighting device as claimed in claim 2, wherein the coupling portion having screw threads therein are disposed on the fastening plate proximate of the fixing hole, so that the rotational portion is adjusted either in a rotatable and tiltable state or in an unrotatable and untiltable state while the fixing portion moves upwardly or downwardly.

7. The lighting device as claimed in claim 6, wherein the fixing portion comprises:

an insertion fastening portion having a screw structure provided at an outer diameter thereof to be engaged with the screw threads;

a body provided at an upper side of the insertion fastening portion, and having a sloped surface having a lower step as an upper surface goes toward a center thereof; and a handle portion coupled to both ends of an outer diametric portion of the body and extending toward an upper side, so as to be rotated by an operator using a hand.

8. The lighting device as claimed in claim 7, wherein a lower locking step is provided on a bottom surface of the insertion fastening portion, and the lighting device further comprises an O-ring located between the lower locking step and the rotational portion.

9. The lighting device as claimed in claim 2, wherein the adjustment shaft portion extends to an upper portion of the rotational portion.

10. The lighting device as claimed in claim 2, wherein the adjustment shaft portion has a hollow interior for connecting an electric wire, and a withdrawal hole provided at a part of a lateral surface thereof to withdraw the electric wire.

11. The lighting device as claimed in claim 10, wherein the withdrawal hole corresponds to a slot.

12. The lighting device as claimed in claim 2, wherein the rotational portion has a spherical shape, and an uneven pattern portion provided at a part of an upper portion thereof to easily rotate the rotational portion.

13. The lighting device as claimed in claim 3, wherein a cylindrical coupling portion having a screw hole formed at a lateral side thereof is located at a part of the fastening plate around the fixing hole, and the fixing portion corresponds to an adjustment bolt so that the rotational portion is adjusted either in an unrotatable and untiltable state or in a rotatable and tiltable state while the rotatably inserted into the fixing hole or is rotatably removed from the fixing hole.

14. A lighting device enabling arbitrary light distribution, the lighting device comprising:

one or more fixing holes provided on a fastening plate;

a rotational portion inserted into the fixing hole to be tilted and rotated; and an optical module portion coupled to the rotational portion, light distribution of the optical module portion being adjusted according to the tilting and the rotating of the rotational portion;

a first rotational portion for rotating in a direction parallel to the fastening plate, a part of an upper portion thereof being upwardly inserted into the fixing hole provided on the fastening plate; and a second rotational portion rotatably coupled to a lower end of the first rotational portion, rotating in a direction perpendicular to the fastening plate, and having a lower end to which the optical module portion is fixed.

15. The lighting device as claimed in claim 14, wherein the first rotational portion comprises:

an insertion tube portion inserted into the fixing hole of the fastening plate;

a rotational plate located at a lower portion of the insertion tube portion, and having a first guide groove within which a bolt is fastened to the fastening plate to perform stable rotation so as to allow the first rotational portion to be in a fixed state or a rotatable state and a first gradation portion provided on a bottom surface thereof to identify a rotation degree; and a connection portion fixed to a lower portion of the rotational plate to allow the second rotational portion to rotate in a direction perpendicular to the fastening plate, and having a second gradation portion for identifying a rotation degree of the second rotational portion.

16. The lighting device as claimed in claim 15, wherein a first indicator for indicating the first gradation portion is provided at the bolt.

17. The lighting device as claimed in claim 15, wherein an electric wire introduced through the insertion tube portion is inserted into the connection portion through an interior of the rotational plate, is extracted through a guide protrusion portion protruding from a surface contacting the second rotational portion of the connection portion, and is then introduced into the second rotational portion.

18. The lighting device as claimed in claim 17, wherein the second rotational portion comprises:

a rotation connection portion being in contact with the connection portion, protruding toward the connection portion side at a rotational center about which the connection portion rotates, and having a fastening protrusion portion inserted into the fastening hole of the connection portion; and a fixing plate coupled to a lower portion of the rotation connection portion, the optical module portion being fixed to a bottom surface thereof.

19. The lighting device as claimed in claim 18, wherein the rotation connection portion further comprises:

a second guide groove having an arc-shape, into which the guide protrusion portion is inserted, and the electric wire extracted from the guide protrusion portion is introduced; and a second indicator for indicating a second gradation portion of the connection portion to indicate an accurate rotation degree.

20. The lighting device as claimed in claim 18, wherein a rotation restraint portion for restraining the rotating is provided at the rotation connection portion.

21. The lighting device as claimed in claim 20, wherein the rotation restraint portion has a plate shape, and comprises bent portions protruding toward the rotation connection portion and the connection portion, respectively.

22. The lighting device as claimed in claim 19, wherein the bottom surface of the fixing plate comprises: a through-hole communicating with the second guide groove such that the electric wire is connected to the optical module portion; and a drainage channel for connecting the through-hole and an edge of the fixing plate.

* * * * *